United States Patent [19]

Holmes

[11] Patent Number: 4,660,730

[45] Date of Patent: Apr. 28, 1987

[54] APPARATUS FOR CONTROLLING MOVEMENT OF VALVE OVERRIDE CONTROL HANDLES

[75] Inventor: William K. Holmes, Delafield, Wis.

[73] Assignee: Hi-Ranger, Inc., Waukesha, Wis.

[21] Appl. No.: 865,778

[22] Filed: May 22, 1986

[51] Int. Cl.[4] ..... F15B 13/08

[52] U.S. Cl. ..... 212/163; 74/491; 74/625; 91/427; 137/637; 137/596.18; 182/2; 182/19

[58] Field of Search ..... 74/625, 491; 91/427; 137/637, 596.18; 182/2, 19; 212/162, 163, 164, 160

[56] References Cited

U.S. PATENT DOCUMENTS 2,946,196 7/1960 Myers .

2,977,769 4/1961 Troche ..... 182/2 X

*Primary Examiner*—Gerald A. Michalsky

*Attorney, Agent, or Firm*—David B. Smith

[57] ABSTRACT

Apparatus for use in supporting a plurality of override control handles of a control valve assembly, the control handles supported for movement in a first direction between engagement and disengagement with the control valve spools and supported for movement in a second direction to cause controlled movement of the valve spools. The apparatus includes a plate having slots housing the control handles and the plate being supported for slideable movement such that movement of one control handle between a valve spool engaging position and a disengaged position causes movement of the other control handles between an engaged position and a disengaged position.

18 Claims, 7 Drawing Figures

APPARATUS FOR CONTROLLING MOVEMENT OF VALVE OVERRIDE CONTROL HANDLES

FIELD OF THE INVENTION

The present invention is directed to hydraulic control valves and to control handles for use in providing manual control of a plurality of valve spools.

BACKGROUND PRIOR ART

Hydraulic control valves of the type normally operated by application of hydraulic pressure at opposite ends of a valve spool commonly also include a control handle or lever for use in manually controlling the position of the valve spool. The control handles are used to override pilot valves.

An example of the use of such control handles is in valves used to control movement of an articulated boom of an aerial lift. Aerial lifts commonly include three or more control valves controlling the supply of hydraulic fluid to hydraulic cylinders and hydraulic motors. These hydraulic cylinders and hydraulic motors are used to control the movement of the articulated boom. The control valves are normally mounted at the base of the boom, and a remote control device is mounted at the operator's platform. The operator uses the remote control device to control pilot valves in turn controlling operation of the control valves. The pilot valves control the delivery of hydraulic fluid to the opposite ends of the valve spools of the control valves and thereby control the relative position of the valve spools.

It is also necessary to provide means for controlling the position of the platform from the ground level, and this means must be capable of overriding the remote control lever at the platform. In the event the remote control handle at the platform jams or malfunctions, an operator at the ground level can control movement of the aerial device by manipulation of the override control handles.

One of the prior art arrangements for use in providing override control for a hydraulic control valve is illustrated in Myers U.S. Pat. No. 2,946,196, issued July 26, 1960.

Other arrangements for providing an override control is illustrated in applicant's U.S. patent application Ser. No. 762,628, filed Aug. 5, 1985 and title Manual Override Control Handle Selectively Engageable with Valve Spool.

SUMMARY OF THE INVENTION

The invention provides an improved arrangement for controlling operation of a plurality of hydraulic control valves of the type used in vehicle mounted aerial lifts, digger derricks and in other applications where a plurality of override control handles are provided for controlling multiple control valves.

The invention includes the combination of hydraulic control valves including reciprocable valve spools, the control valves being positioned in generally parallel adjacent relation, and each control valve including a control handle supported for movement in a first direction, transverse to the direction of movement of the valve spool, between a position wherein the control handle is disengaged from the valve spool and a position wherein a portion of the control handle engages the valve spool and such that movement of the control handle in the direction of reciprocal movement of the valve spool will cause such movement of the valve spool. The control handles are positioned in side by side spaced apart relation. Means are also provided for supporting the control handles for simultaneous movement between the disengaged position and the engaged position, and such that when one control handle is moved to the engaged position, all of the control handles are moved to the valve spool engaging position.

In one preferred form of the invention the means for supporting the control handles includes a plate including a plurality of spaced apart parallel slots, the slots housing respective ones of the control handles. The plate is supported for reciprocal movement between a position wherein the control handles are disengaged from the valve spools to a position wherein the control handles engage the valve spools.

In one embodiment of the invention means are provided for resiliently biasing the movable plate toward a position wherein the control handles are disengaged.

In a preferred form of the invention, switch means are also provided, the switch means being engaged by the movable plate when the movable plate is moved to the position wherein the control handles are engaged with the valve spools.

Various other features and advantages of the invention will be apparent by reference to the following description of a preferred embodiment, to the claims, and to the drawings.

Figure 1:
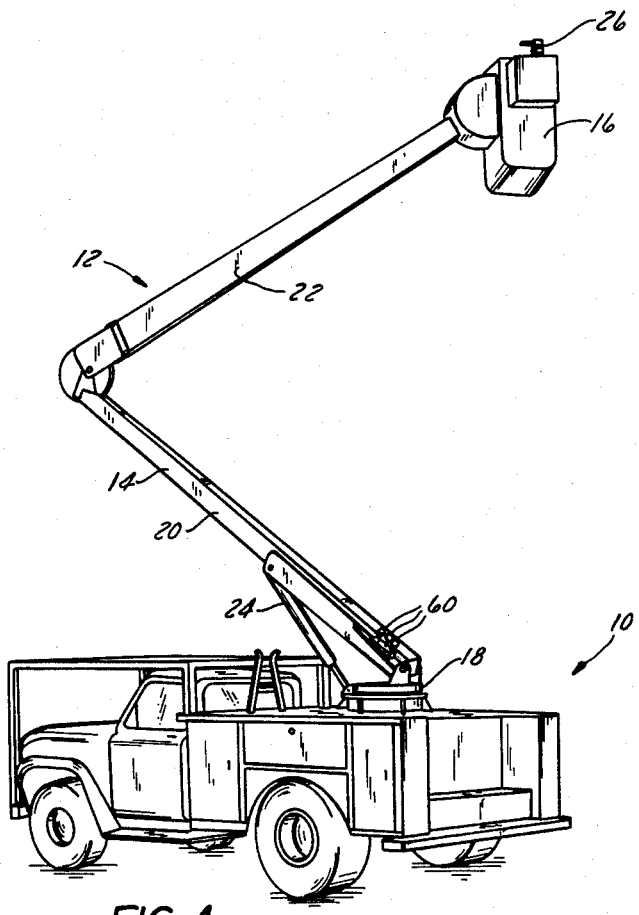
FIG. 1 is a perspective view of a utility truck supporting an aerial device including a valve control handle arrangement embodying the present invention.
Figure 2:
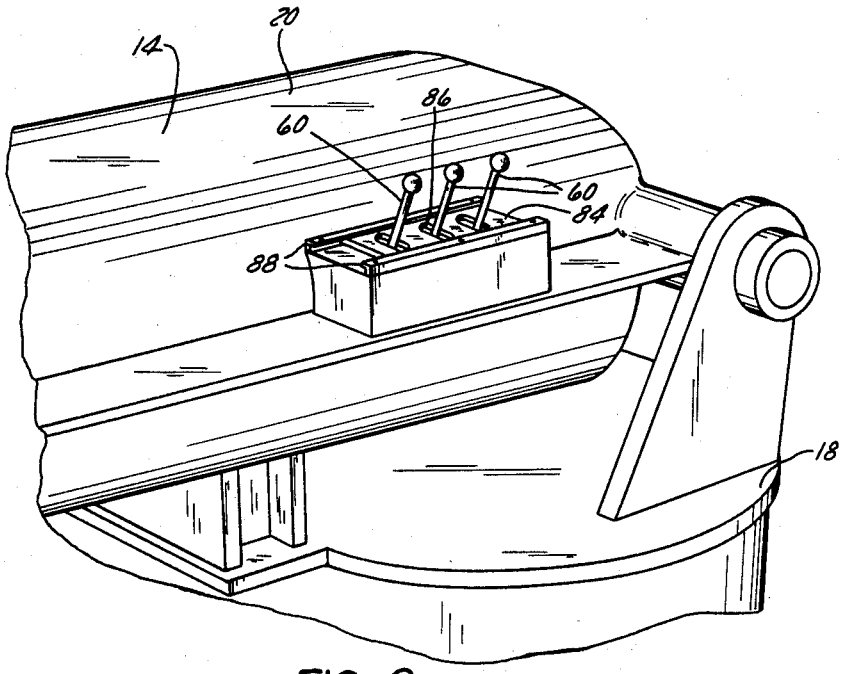
FIG. 2 is an enlarged perspective view of the valve control handle arrangement illustrated in FIG. 1.

Before describing at least one embodiment of the invention in detail, it is to be understood that the invention is not limited in its application to the details of construction and to the specific steps set forth in the following description or illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF A PREFERRED EMBODIMENT

Illustrated in FIG. 1 is a truck 10 supporting an aerial lift 12, the aerial lift including an articulated boom 14 supporting a bucket or platform 16 adapted to carry an operator. The articulated boom 14 is supported by a turntable 18 for rotation about a vertical axis. The articulated boom 14 includes a first boom section 20 pivotally joined at its lower end to the turntable 18 and having an upper end supporting a second boom section 22. The upper end of the second boom section supports the bucket or platform 16. A conventional hydraulic motor (not shown) is provided for causing rotation of the articulated boom 14 about a vertical axis of the turntable 18. A hydraulic cylinder 24 is supported by the turntable 18 and is pivotally joined at its upper end to the first boom section 20 to cause selective vertical movement of the upper end of the first boom section 20. A second hydraulic cylinder (not shown) is supported in a conventional manner in the upper end of the first boom section 20 and is operably connected to the second boom second 22 to cause movement of the second boom section 22 with respect to the first boom section 20 and thereby cause vertical movement of the bucket 16. As is conventional, a control handle 26 is mounted at the bucket 16 and is operably connected to three hydraulic valves 30, 32 and 34 (FIG. 3) controlling the rotary hydraulic motor, the first hydraulic cylinder 24, and the second hydraulic cylinder.

While the three hydraulic control valves 30, 32 and 34 could be supported in various ways, and could be mounted on the truck 10, in the illustrated arrangement the control valves 30, 32 and 34 are mounted in a conventional manner at the base of the first boom section 20 and adjacent the turntable 18.

Figure 4:
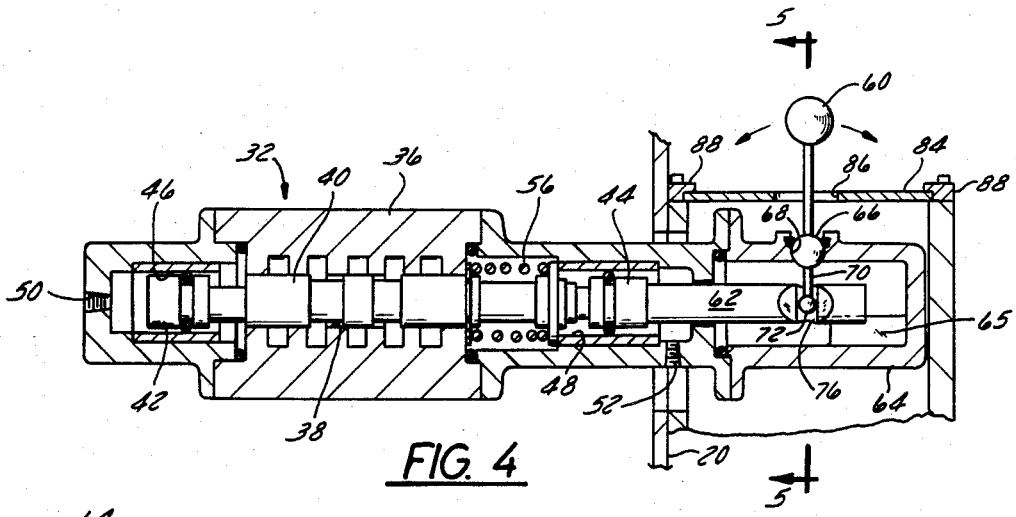
FIG. 4 is an enlarged cross section elevation view of one of the valves illustrated in FIG. 3 and taken along line 4—4 in FIG. 3.

The control valve 32 is illustrated in FIG. 4 and is shown as including a valve body 36 having a central valve bore 38 housing a reciprocably movable valve spool 40. Means are also provided for causing selective movement of the valve spool 40 in the valve bore 38 is response to movement of the control handle 26 mounted at the bucket 16. While various means could be provided for controlling movement of the valve spool 40, in the illustrated construction, opposite ends of the valve spool 40 form pistons 42 and 44 and are housed in cylinders 46 and 48, respectively, provided in the opposite ends of the valve body 36. A first fluid port 50 admits pilot hydraulic fluid to the cylinder 46 and a second fluid port 52 admits pilot hydraulic fluid to the other cylinder 48. As is conventional, the fluid ports 50 and 52 are operably connected to the remote control handle 26 at the platform 16 such that movement of the remote control handle controls the supply of hydraulic fluid to the fluid ports 50 and 52 and thereby controls movement of the valve spool 40. A centering spring 56 is also provided to bias the valve spool 40 toward a central neutral position.

Means are also provided for manually controlling the control valves 30, 32 and 34 and for overriding the operation of the remote control handle 26 at the bucket. It is important that a control means be provided such that the operator on the ground can control the position of the aerial device. It is also important that this control means be capable of overriding the remote control handle 26 at the platform 16 in the event that the control handle 26 malfunctions or becomes jammed or in the event the operator becomes incapacitated. It is also important that the means for manually controlling the control valves 30, 32 and 34 provide for precise control of the bucket position. The means for manually controlling the control valves and for overriding the operation of the remote control handle 26 includes a plurality of control levers 60 selectively engageable with respective ones of the valve spools 40 and operable to permit an operator to manually control the position of the valve spools and to override the effect of hydraulic fluid pressure supplied to the cylinders 46 and 48.

One of the control levers 60 is illustrated in FIGS. 4–7 and is supported for pivotable movement between a first position wherein the control lever 60 does not engage the valve spool 40 and wherein the valve spool is freely movable independently of the control lever 60 and a second position wherein a portion of the control lever 60 engages the valve spool 40 such that pivotal movement of the control lever 60 causes direct movement of the valve spool 40 in the direction of the longitudinal axis of the valve spool.

While in other arrangements the control lever 60 could be connected to the valve spool in other ways, in the illustrated arrangement, the valve spool includes a valve spool extension 62 projecting from one end of the valve spool and housed in a valve body extension 64 for reciprocal movement therein.

Means are also provided for supporting the control lever 60 for pivotal movement about a first axis intermediate its opposite ends between a disengaged position and a valve spool engaging position. The means for supporting the control lever also supports the control lever for pivotal movement in a second direction to cause linear movement of the valve spool 40. While the control lever 60 could be supported in other ways, in the illustrated arrangement, the control lever is supported by a sealed ball and socket arrangement. A ball 66 is fixed to the control lever 60 intermediate its oppoosite ends and is housed in a socket 68 defined by an aperture provided in the valve body extension 64. The lower end 70 of the control lever 60 extends into the valve body extension 64 and supports a ball 72 which is rigidly fixed to the lower end 70 of the control lever. The ball 66 and socket 68 arrangement for supporting the control lever 60 permits relatively free universal movement of the upper end of the control lever.

The valve spool extending 62 also includes a notch 76 adapted to selectively house the ball 72 provided at the lower end of the control lever 60. In operation of the manual valve control means shown in the drawings, when the control lever 60 is in the position shown in solid lines in FIG. 5, the lower end 70 of the control lever is positioned out of the notch 76 in the valve spool extension 62 and the valve spool 40 is freely movable in the direction of its longitudinal axis with respect to the control lever 60. When the upper end of the control lever 60 is moved to the phantom line position shown in FIG. 5, the lower end 70 of the control lever is moved into the notch 76 provided in the valve spool extension 62. If the upper end of the control lever 60 is then moved in the direction of the longitudinal axis of the valve spool 40, such movement of the control lever will cause movement of the valve spool 40 and permit the operator to control the position of the valve spool 40.

Figure 6:
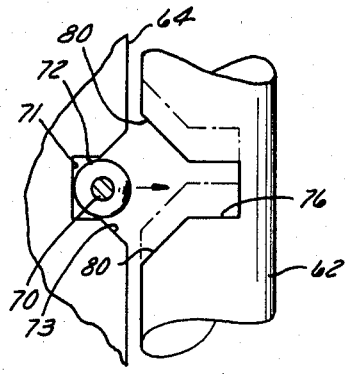
FIG. 6 is an enlarged view taken along line 6—6 in FIG. 5.
Figure 7:
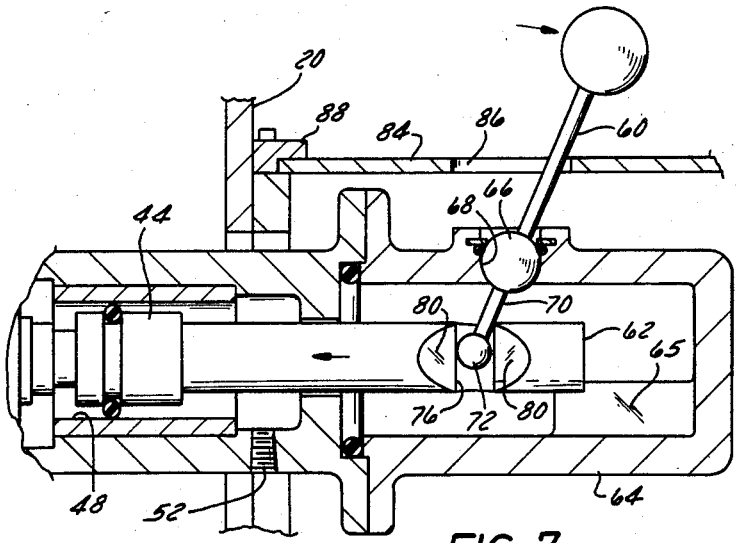
FIG. 7 is an enlarged partial view of the control valve and control lever illustrated in FIG. 4 and showing a control lever in a valve spool controlling position.

As illustrated in FIG. 6, in one embodiment of the invention the notch 76 includes bevelled sides 80 converging toward the central portion of the notch. The bevelled sides 80 permit the lower end 70 of the control lever 60 to be forced into the notch 76 when the valve spool 40 is at either of the opposite ends of its stroke. In operation of the control lever, and assuming the valve spool extension 62 is in a position as illustrated in phantom in FIG. 6, the ball 72 at the lower end 70 of the control lever can be forced against the bevelled surface 80 of the notch thereby applying a force on the valve spool 40 in the direction of its longitudinal axis and causing alignment of the notch 76 with the end 70 of the control lever to thereby permit the end 70 of the control lever to be forced into the slot.

In the preferred form of the invention, the valve body extension 64 also includes a notch 71 adapted to house the ball 72 of the control handle 60 when the control handle 60 is in the disengaged position. The sides 73 of the notch 71 are bevelled to guide the ball 72 of the control handle into the notch 71 when the control handle 60 is moved to its disengaged position. The ball 72 of the control handle 60 will then be centered for engagement with the valve spool 62.

In the illustrated arrangement, the valve body extension also includes a key 65 adapted to be housed in a slot provided in the lower surface of the end of the valve spool extension 62. The key 65 prevents rotation of the valve spool about its central longitudinal axis to facilitate alignment of the ball 72 with the complementary slot 76.

While in the particular embodiment of the invention illustrated in the drawings, the lower end 70 of the control lever 60 is selectively engageable with the valve spool extension 62 and means are provided for supporting the control lever 60 for pivotable movement about a point intermediate its opposite ends, in other arrangements, the end of the control lever 60 could be pivotally supported, and an intermediate portion of the control lever 60 could engage the valve spool 40.

While the description above refers to only a single control lever 60, each of the three control valves 30, 32 and 34 includes a manual control lever 60 as illustrated in FIG. 4 and for controlling operation of that respective control valve.

Means are also provided for resiliently biasing all of the control levers 60 toward a disengaged position and for causing movement of the three control levers 60 in unison between the engaged and disengaged position while also facilitating independent movement of the control levers 60 with respect to one another in a direction causing linear movement of the valve spools. In the illustrated construction, this means includes a plate 84 provided with the thrre longitudinally extending slots 86. The plate 84 is mounted such that the longitudinally extending slots are parallel to the longitudinal axes of the valve spools 40. The longitudinally extending slots 86 are spaced apart such that the control levers 60 can be housed in respective ones of the longitudinally extending slots 86.

Figure 5:
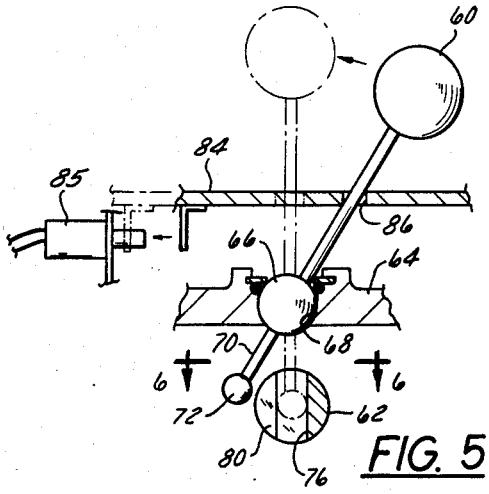
FIG. 5 is an enlarged cross section view taken along line 5—5 in FIG. 4.

Means are also provided for supporting the plate 84 for reciprocal movement in a direction transverse to the direction of the slots 86, and between a first position as illustrated in solid lines in FIG. 5 and wherein the control levers 60 are disengaged from the valve spools 40 and a second position as shown in phantom in FIG. 5 and wherein the control levers 60 engage the valve spools 40 to cause direct longitudinal reciprocal movement of the valve spools. While various means could be used to support the plate 84 for linear reciprocal movement, in the illustrated arrangement a pair of tracks 88 are provided for slideably supporting the plate. A spring 90 is also provided for resiliently biasing the plate 84 toward the disengaged position shown in FIG. 3.

Figure 3:
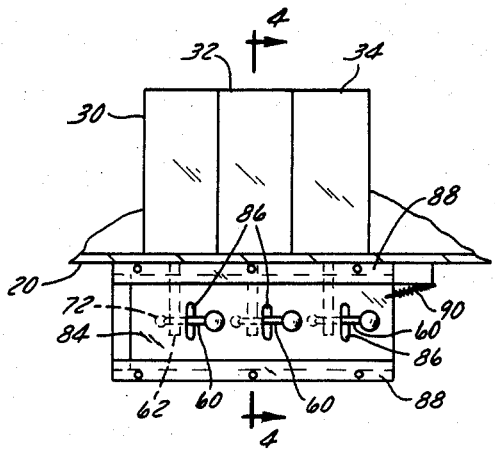
FIG. 3 is a plan view of the control valve arrangement illustrated in FIG. 2.

In operation of the manual control levers 60, the operator can grasp one of the control levers and move the upper end of that control lever to the left as viewed in FIG. 3. Such movement of the control lever moves the plate 84 to the left, and the plate 84 carries the other levers 60 to the left such that all three control members are in engagement with respective ones of the valve spools 40 and such that the operator can control any one of the valve spools 40 by operating the associated control lever 60.

In the illustrated arrangement means are further provided for actuating an electrical interlock when the plate is moved to the position wherein the control handles 60 all operatively engage the valve spool extensions 62. This means includes an electrical switch 85 positioned so as to be engaged by the plate 84 when the plate 84 is moved to the position wherein the control handles 60 engage the valve spools. The electrical switch 85 is functional to interrupt or disconnect the control handle 26 mounted at the platform 16 from the control valves 30, 32 and 34 when the plate 84 is moved to a position wherein the control handles 60 engage the valve spools.

Various features of the invention are set forth in the following claims.

I claim:

1. Apparatus for use in controlling operation of a plurality of hydraulic control valves wherein said hydraulic control valves are positioned in parallel adjacent relation, said hydraulic control valves each including reciprocably movable valve spools and control handles for selectively causing controlled reciprocal movement of the valve spools to control operation of the hydraulic control valves, the control handles each being supported for movement in a first direction between a disengaged position and a valve spool engaging position and for movement in a second direction when the control handle is in the valve spool engaging position to cause controlled movement of the valve spool, the apparatus for controlling operation of a plurality of control valves comprising:

means for causing simultaneous movement of the control handles in the first direction between the valve spool engaging position and the disengaged position, said means for causing simultaneous movement including a plate, said plate including a plurality of spaced apart slots, said control handles extending through said slots, said slots extending in the direction of linear reciprocal movement of the valve spools, and said slots permitting movement of said control handles in the direction of linear reciprocal movement of the valve spools, and means for supporting said plate for movement in said first direction whereby movement of one of said control handles in said first direction causes movement of said plate and said other of said control handles in said first direction with said one of said control handles.

2. Apparatus as set forth in claim 1 wherein said control handles are supported for pivotal movement about a pivot axis and wherein said plate is spaced from said pivot axis.

3. Apparatus as set forth in claim 1 wherein said plate is movable between a disengaged position wherein said control handles are disengaged from said valve spools and an engaged position wherein said control handles engage said valve spools, and further including means for resiliently biasing said plate toward said disengaged position.

4. Apparatus as set forth in claim 1 wherein said valve spools are freely movable with respective to said control handles when said control handles are in said disengaged position.

5. Apparatus as set forth in claim 1 wherein said means for supporting said plate includes slide means supporting said plate for slideable movement between an engaged position and a disengaged position.

6. Apparatus as set forth in claim 1 wherein said plate is movable between a disengaged position wherein said control handles are disengaged from said valve spools and an engaged position wherein said control handles engage said valve spools, and further includng switch means engaged by said plate when said plate is moved to one of said engaged position and said disengaged position.

7. A boom assembly comprising a support structure a first boom section connected to the support structure and supported for movement with respect to the support structure a second boom section connected to the first boom section and supported for movement with respect to the first boom section a first fluid motor for causing movement of the first boom section with respect to the support structure, a second fluid motor for causing movement of the second boom section with respect to the first boom section, a first hydraulic control valve operably connected to said first fluid motor and for controlling operation of said first fluid motor, a second hydraulic control valve operably connected to said second fluid motor and for controlling operation of said second fluid motor, said hydraulic control valves being positioned in parallel adjacent relation and each including reciprocably movable valve spools, and control handles for selectively causing controlled linear reciprocal movement of said valve spools to control operation of said hydraulic control valves, the control handles each being supported for movement in a first direction between a disengaged position and a valve spool engaging position and for movement in a second direction when the control handles are in the valve spool engaging position to cause controlled movement of the valve spools, and means for causing simultaneous movement of the control handles in a first direction between the valve spool engaging position and the disengaged position, said means for causing simultaneous movement including, a plate, said plate including a plurality of spaced apart slots extending in the direction of movement of the valve spools, said control handles extending through said slots, and said slots permitting movement of said control handles in the direction of linear reciprocal movement of the valve spools, and means for supporting said plate for movement in said first direction whereby movement of one of said control handles in said first direction causes movement of said plate and said other of said control handles in said first direction with said one of said control handles.

8. A boom assembly as set forth in claim 7 wherein said control handles are supported for pivotal movement about a pivot axis and wherein said plate is spaced from said pivot axis.

9. A boom assembly as set forth in claim 7 wherein said plate is movable between a disengaged position wherein said control handles are disengaged from said valve spools and an engaged position wherein said control handles engage said valve spools, and further including means for resiliently biasing said plate toward said disengaged position.

10. A boom assembly as set forth in claim 7 wherein said valve spools are freely movable with respect to said control handles when said control handles are in said disengaged position.

11. A boom assembly as set forth in claim 7 wherein said means for supporting said plate includes slide means supporting said plate for slideable movement between an engaged position and a disengaged position.

12. A boom assembly as set forth in claim 7 wherein said plate is movable between a disengaged position wherein said control handles are disengaged from said valve spools and an engaged position wherein said control handles engage said valve spools, and further including switch means engaged by said plate when said plate is moved to one of said engaged position and said disengaged position.

13. A control valve assembly for use in controlling operation of a plurality of hydraulic fluid motors, said control valve assembly comprising:

a plurality of hydraulic control valves, said hydraulic control valves being positioned in parallel adjacent relation, said control valves each including a reciprocably movable valve spool, control handles for selectively causing controlled linear reciprocal movement of the valve spools to control operation of the hydraulic control valves, the control handles each being supported for movement in a first direction between a disengaged position and a valve spool engaging position and for movement in a second direction when the control handle is in the valve spool engaging position to cause controlled movement of the valve spool, and means for causing simultaneous movement of the control handles in the first direction between the valve spool engaging position and the disengaged position, said means for causing simultaneous movement including a plate, said plate including a plurality of spaced apart slots, said control handles extending through said slots, and said slots permitting movement of said control handles in the direction of linear reciprocal movement of the valve spools, and means for supporting said plate for movement in said first direction whereby movement of one of said control handles in said first direction causes movement of said plate and said other of said control handles in said first direction with said one of said control handles.

14. A control value assembly as set forth in claim 13 wherein said control handles are supported by pivotal movement about a pivot axis and wherein said plate is spaced from said pivot axis.

15. A control valve assembly as set forth in claim 13 wherein said plate is movable between a disengaged position wherein said control handles are disengaged from said valve spools and an engaged position wherein said control handles engage said valve spools, and further including means for resiliently biasing said plate toward said disengaged position.

16. A control valve assembly as set forth in claim 13 wherein said valve spools are freely movable with respect to said control handles when said control handles are in said disengaged position.

17. A control valve assembly as set forth in claim 13 wherein said means for supporting said plate includes slide means supporting said plate for slideable movement between an engaged position and a disengaged position.

18. A control valve assembly as set forth in claim 13 wherein said plate is movable between a disengaged position wherein said control handles are disengaged from said valve spools and an engaged position wherein said control handles engage said valve spools and further including switch means engaged by said plate when said plate is moved to said engaged position.

* * * * *